United States Patent [19]

Woolslayer

[11] 4,390,162

[45] Jun. 28, 1983

[54] INFINITELY VARIABLE CROWN BLOCK POSITIONING

[75] Inventor: Joseph R. Woolslayer, Tulsa, Okla.

[73] Assignee: Lee C. Moore Corporation, Tulsa, Okla.

[21] Appl. No.: 265,438

[22] Filed: May 20, 1981

[51] Int. Cl.[3] ..... B66D 1/82

[52] U.S. Cl. ..... 254/398; 254/399

[58] Field of Search ..... 254/399, 398, 413, 335, 254/336, 337, 338

[56] References Cited

U.S. PATENT DOCUMENTS

| | | | |
|---|---|---|---|
| 1,108,078 | 8/1914 | Kline | 254/398 |
| 1,588,872 | 6/1926 | Boykin, Jr. | 254/398 |
| 1,691,430 | 11/1928 | Campbell | 254/398 |
| 2,601,611 | 6/1952 | Hilborn et al. | 254/399 |
| 3,469,820 | 9/1969 | Horton | 254/377 |
| 3,652,058 | 3/1972 | Ashton | 254/398 |

*Primary Examiner*—Billy S. Taylor

*Attorney, Agent, or Firm*—Carothers & Carothers

[57] ABSTRACT

Mounted in the upper part of an oil well drilling derrick are horizontal crown beams having end portions projecting beyond the opposite sides of the derrick. A fast line sheave and a dead line sheave are mounted on those beams near the opposite sides of the derrick, and a crown block is mounted on the beams between those sheaves. The sheaves and the crown block are adjustable along the beams. The fast line sheave is movable outwardly into an inactive position on the adjacent projecting end portions of the beams when the crown block is in a position suitable for supporting a fast line directly, and the dead line sheave is movable outwardly into an inactive position on the adjacent projecting portions of the beams when the crown block is in a position suitable for supporting a dead line directly. When both sheaves are in operating positions, the crown block can be placed in any desired location between them.

6 Claims, 5 Drawing Figures

INFINITELY VARIABLE CROWN BLOCK POSITIONING

In large oil well drilling derricks, provision often is made for shifting the crown block into different positions so that more than one well can be drilled without moving the derrick. However, in the past the arrangement has been such that the crown block can only be moved into a predetermined number of set positions, which limits the number and locations of wells that can be drilled without moving the derrick.

It is among the objects of this invention to provide an oil well drilling derrick with a crown block that can be moved in a straight line into an infinite number of different positions for drilling wells wherever desired between opposite sides of the derrick.

The preferred embodiment of the invention is illustrated schematically in the accompanying drawings, in which.

Figure 1:
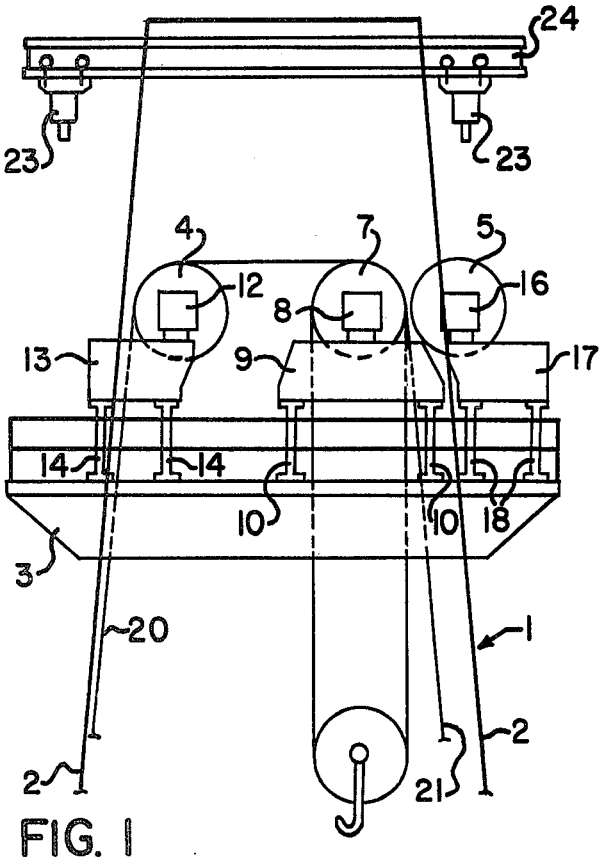
FIG. 1 is a side view of the upper portion of a derrick with the crown block shown close to one side of the derrick.
Figure 2:
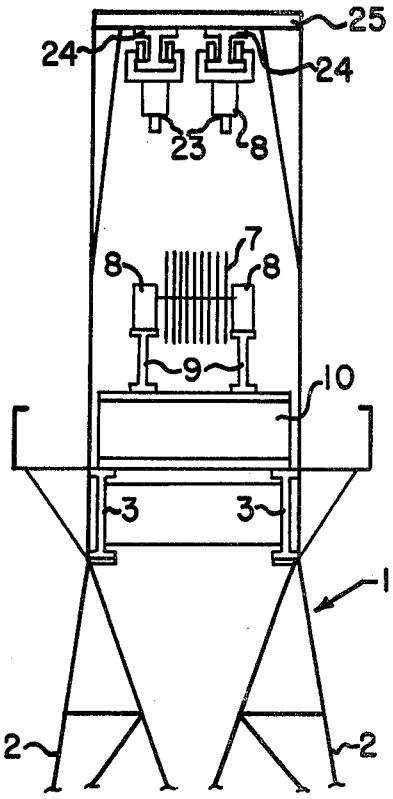
FIG. 2 is a view at right angles to FIG. 1 and with the wire lines omitted.
Figure 3:
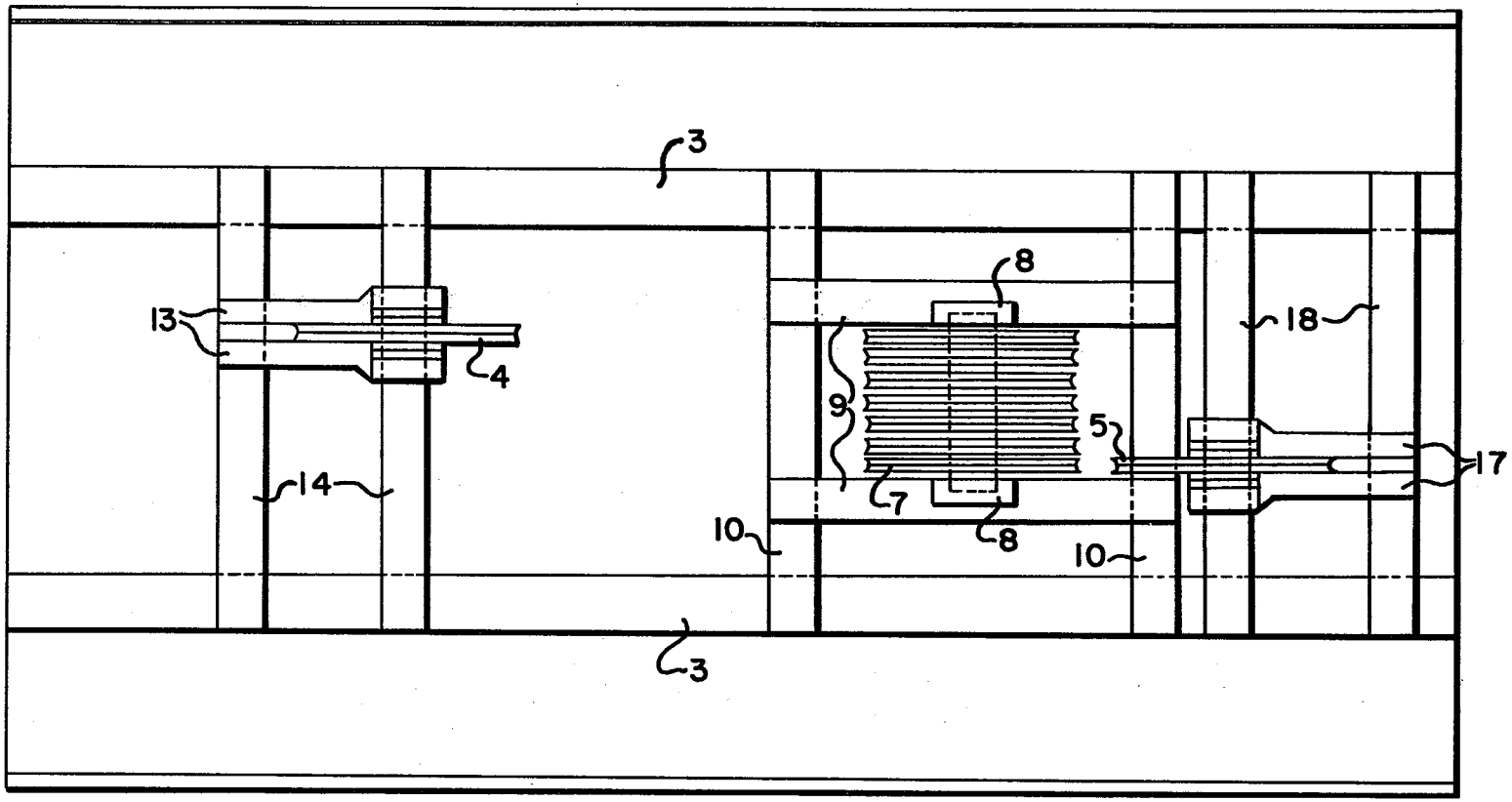
FIG. 3 is an enlarged plan view of the crown arrangement shown in FIG. 1 but without the wire lines.

Referring to FIGS. 1, 2 and 3 of the drawings, an oil well drilling derrick 1 has corner legs 2 that support near the upper part of the derrick a pair of parallel horizontal crown beams 3 that extend out beyond the opposite sides of the derrick. Supported by these beams are a fast line sheave 4, a dead line sheave 5 and a crown block between the two sheaves. The crown block includes the usual cluster of sheaves 7, the axis of rotation of which extends transversely of the beams. This cluster of sheaves is supported by bearings 8 mounted on short I-beams 9, which in turn are mounted on cross beams 10, the ends of which are supported by crown beams 3.

The fast line sheave is journaled in bearings 12 mounted on the inner ends of short I-beams 13, which in turn are mounted on cross beams 14 resting on the crown beams. The dead line sheave is journaled in bearings 16 on the inner ends of short I-beams 17 mounted on cross beams 18 likewise resting on the crown beams. The fast line sheave and the dead line sheave are disposed diagonally of each other on opposite sides of the crown block as shown in FIG. 3. All of the cross beams just mentioned are adjustable or movable lengthwise of the crown beams. Each pair of cross beams 14 and 18 can be bolted in two different positions to the crown beams as will be explained. The cross beams 10 of the crown block can be placed in many different locations along the crown beams and held in place by suitable clamps.

In the arrangement shown in FIG. 1, the fast line sheave 4 is located just inside the derrick and receives the fast line 20 from the drawworks below (not shown). The fast line passes over the sheave and extends across to the crown block, which is shown near the opposite side of the derrick in a position for drilling a well as close as possible to the adjacent side of the derrick. In that location the dead line sheave 5 is unnecessary because the position of the crown block is suitable for the dead line 21 to extend directly from the crown block down to its anchor (not shown) at the lower end of the derrick. Since it is not necessary to use the dead line sheave and since it would otherwise be in the way of the crown block, the dead line sheave is moved out onto the adjacent projecting end portions of the crown beams to an inactive or storage position mainly outside of the derrick.

Figure 4:
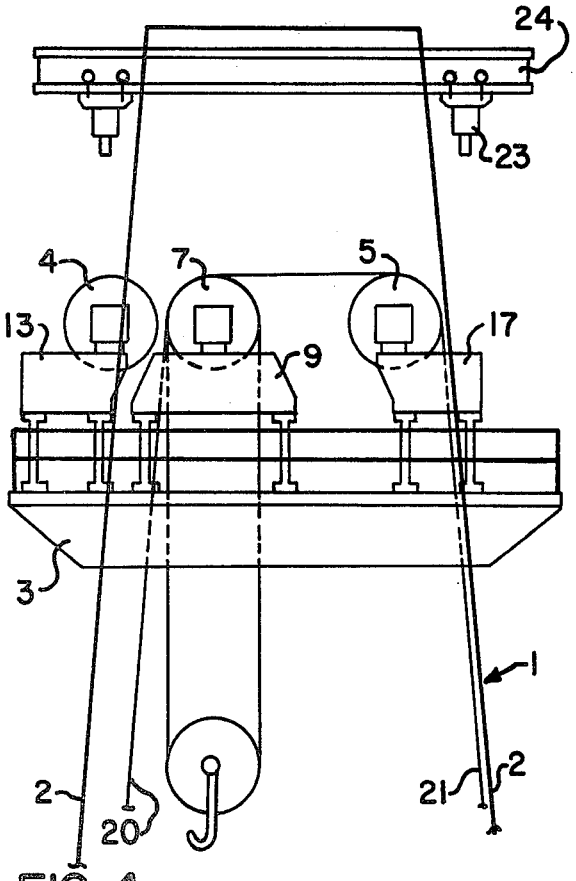
FIG. 4 is a view similar to FIG. 1 but showing the crown close to the opposite side of the derrick.

To drill a well at the opposite side of the derrick, the fast line sheave is moved out onto the adjacent projecting end portions of the crown beams and the crown block is moved from its position in FIG. 1 to the opposite side of the derrick into the location previously occupied by the fast line sheave. In this location, as shown in FIG. 4, the crown block can receive the fast line directly from the drawworks, so the fast line sheave is not needed. As part of the same operation, the dead line sheave is moved inwardly along the crown beams into active position near the adjacent side of the derrick. The dead line now extends from the crown block over to the dead line sheave and down the inside of the mast to the dead line anchor.

Figure 5:
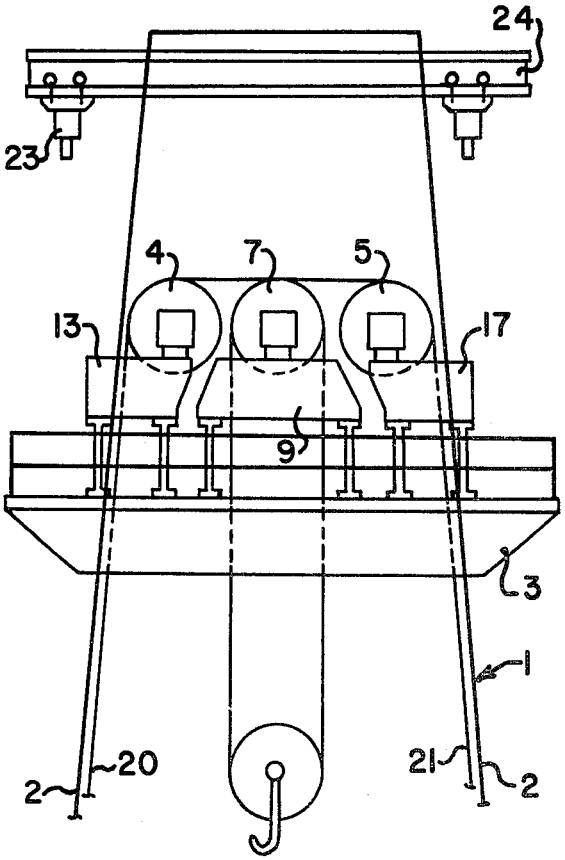
FIG. 5 is a similar view, but with the crown block in a central position.

If it is desired to drill a well at the center of the derrick, the crown block is moved along the crown beams 3 to a central position, as shown in FIG. 5, and the fast line sheave is moved back to the position it occupied in FIG. 1. The fast line now extends over the fast line sheave to the crown block, and the dead line extends from the crown block to the dead line sheave. It will be seen that both the fast line sheave and the dead line sheave are used in this position of the crown block.

It is a feature of this invention that the crown block is not limited to the three positions just described but can be located along the crown beams at any desired point between its two extreme side positions shown. This provides great flexibility in the location and number of the wells that can be drilled.

In order to move the crown block and the fast line sheave and dead line sheave along the crown beams for different well locations, hoists are located above them. These hoists 23, of any suitable construction, roll along a pair of parallel tracks 24 in the form of I-beams. The two tracks are supported by cross beams 25 (FIG. 2) between the upper ends of the derrick legs. One track is located above the fast line sheave and the other track is located above the dead line sheave. When the fast line sheave is to be moved, the hoist suspended from the track above that sheave is connected with the sheave, which is then raised slightly by the hoist and then moved in either direction along the crown beams as desired. The same procedure is followed with the dead line sheave, which is raised and moved by the other hoist. In order to move the crown block along the crown beams, both hoists are connected with it as it is much heavier than either the fast line sheave or the dead line sheave.

It will be seen that without moving the derrick the various sheaves can readily be moved to different locations for drilling wells in various locations within the base of the derrick.

According to the provisions of the patent statutes, I have explained the principle of our invention and have illustrated and described what we now consider to represent its best embodiment. However, we desire to have it understood that, within the scope of the appended claims, the invention may be practiced otherwise than as specifically illustrated and described.

I claim:

1. In an oil well drilling derrick, parallel horizontal crown beams mounted in the upper part of the derrick and having end portions projecting beyond its opposite sides, a fast line sheave near one side of the derrick and a dead line sheave near the opposite side, means supporting the sheaves on said beams with their axes of rotation extending transversely of the beams for selective adjustment lengthwise of the beams to respective inactive positions on the projecting end portions and to active positions inboard, and a crown block mounted on the beams between said sheaves with its axis of rotation extending transversely of the beams, means supporting the crown block on said beams for adjustable movement therealong between the opposite sides of the derrick.

2. In an oil well drilling derrick as recited in claim 1, said means supporting the crown block including cross beams resting on said crown beams and supporting said crown block, said cross beams being movable laterally along the crown beams to various positions.

3. In an oil well drilling derrick as recited in claim 1, said sheave-supporting means including cross beams resting on said crown beams and movable laterally along them.

4. In an oil well drilling derrick as recited in claim 1, said fast line sheave and dead line sheave being disposed in parallel vertical planes perpendicular to said crown block axis.

5. In an oil well drilling derrick as recited in claim 1, hoisting and transporting means in the derrick above said crown block for lifting said sheaves and crown block and moving them lengthwise of said crown beams.

6. In an oil well drilling derrick as recited in claim 5, said hoisting and transporting means including parallel tracks rigidly mounted in the derrick parallel to said crown beams, one track being disposed above the fast line sheave and the other track being disposed above the dead line sheave, and a hoist suspended from each track and movable along it.

* * * * *